US006145926A

United States Patent [19]

Lin

[11] Patent Number: 6,145,926

[45] Date of Patent: Nov. 14, 2000

[54] COMPUTER CHAIR DEVICE

[76] Inventor: Kuan Jen Lin, 58, Ma Yuan West, Taichung, Taiwan

[21] Appl. No.: 09/195,833

[22] Filed: Nov. 17, 1998

[51] Int. Cl.[7] ..... A47C 7/72

[52] U.S. Cl. ..... 297/217.3; 297/170; 297/188.11; 297/188.14

[58] Field of Search ..... 297/170, 173, 297/174, 188.08, 188.11, 188.14, 217.3, 217.7

[56] References Cited

U.S. PATENT DOCUMENTS

| | | | |
|---|---|---|---|
| 155,016 | 9/1874 | Eberhard | 297/423.21 |
| 321,595 | 7/1885 | Gray | 297/423.21 X |
| 818,917 | 4/1906 | Ruger | 297/173 |
| 860,328 | 7/1907 | Rose | 297/173 X |
| 1,030,876 | 7/1912 | Derry | 297/423.21 X |
| 5,503,457 | 4/1996 | Rosado | 297/170 X |
| 5,653,499 | 8/1997 | Goodall | 297/173 X |

FOREIGN PATENT DOCUMENTS

| | | | |
|---|---|---|---|
| 292824 | 6/1928 | United Kingdom | 297/173 |
| 544536 | 4/1942 | United Kingdom | 297/188.14 |

*Primary Examiner*—Peter R. Brown

[57] ABSTRACT

A computer chair device has a main frame, a main body disposed in the main frame, a support rod disposed on the main frame, a table plate disposed on the support rod, two support posts disposed on the main frame, and two upper plates disposed on the support posts. The main frame has a plurality of bottom rods. A base plate is disposed on the bottom rods. A slide plate is disposed on the bottom rods. A protruded block is disposed on the slide plate.

1 Claim, 6 Drawing Sheets

COMPUTER CHAIR DEVICE

BACKGROUND OF THE INVENTION

The present invention relates to a computer chair device. More particularly, the present invention relates to a computer chair device which can receive a plurality of articles.

A conventional computer chair is not so important as a computer table. Thus a plurality of computer periphery articles are disposed on a large computer table. Therefore, the user does not feel comfortable to sit on a small computer chair. Since the large computer table cannot be designed to fit the operation habit of the user, the user should move the computer chair from a place to another place. Therefore, the user will feel uncomfortable after a long period of sitting on the small computer chair.

SUMMARY OF THE INVENTION

An object of the present invention is to provide a computer chair device which has a plurality of slide plates to receive a plurality of articles.

Another object of the present invention is to provide a computer chair device to facilitate the operation of the user. Therefore, a computer table is only a portion of the computer chair. The present invention provides a large computer chair device instead of a conventional large computer table. The computer table of the present invention is relatively small.

Accordingly, a computer chair device comprises a main frame, a main body supported by the main frame, a support rod disposed on the main frame, a table plate disposed on the support rod, two support posts disposed on the main frame, and two upper plates disposed on the support posts. The main frame comprises a plurality of bottom rods connected to the main frame. A base plate is disposed on the bottom rods. A button is disposed on the support rod to adjust the support rod. A slide plate is disposed on the bottom rods. A protruded block is disposed on the slide plate to limit a movement of the slide plate while the slide plate is pulled outward.

DETAILED DESCRIPTION OF THE INVENTION

Figure 1:
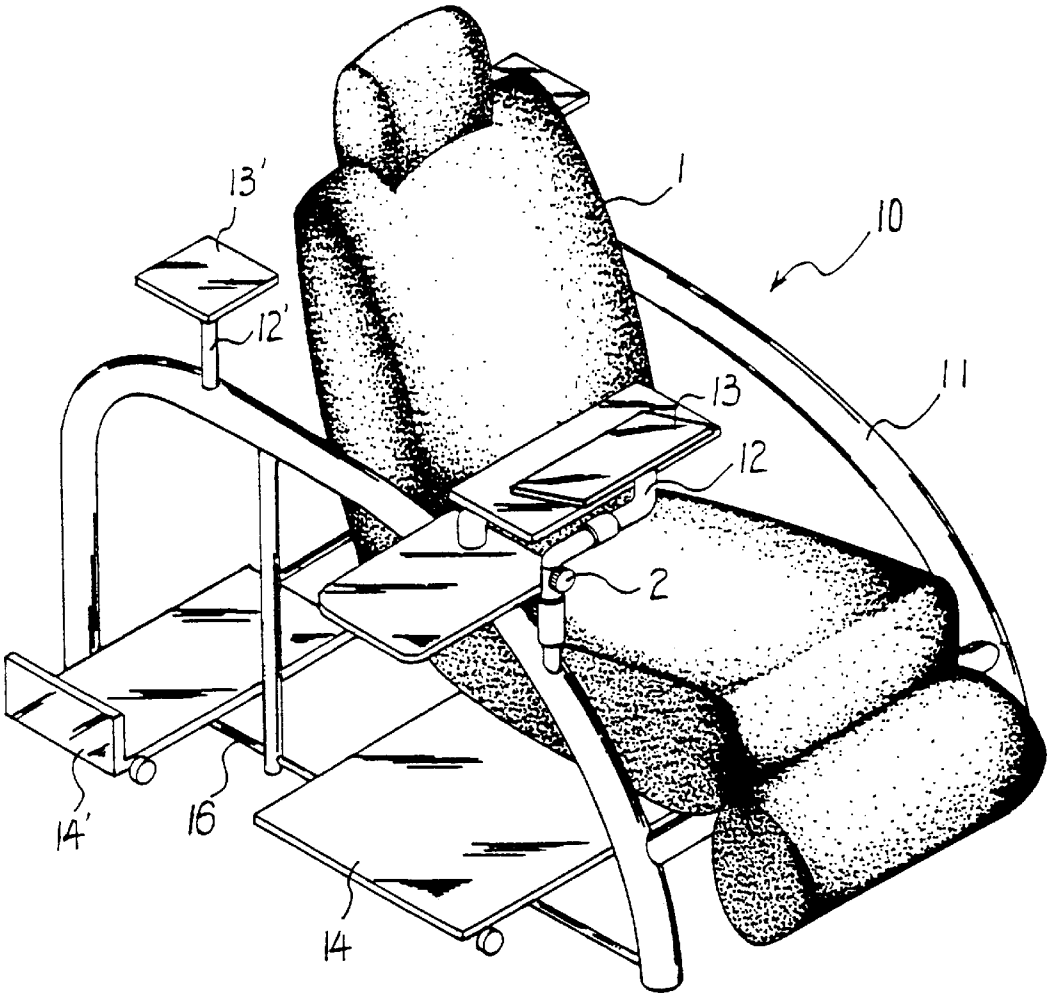
FIG. 1 is a perspective assembly view of a computer chair device of a preferred embodiment in accordance with the present invention.
Figure 1A:
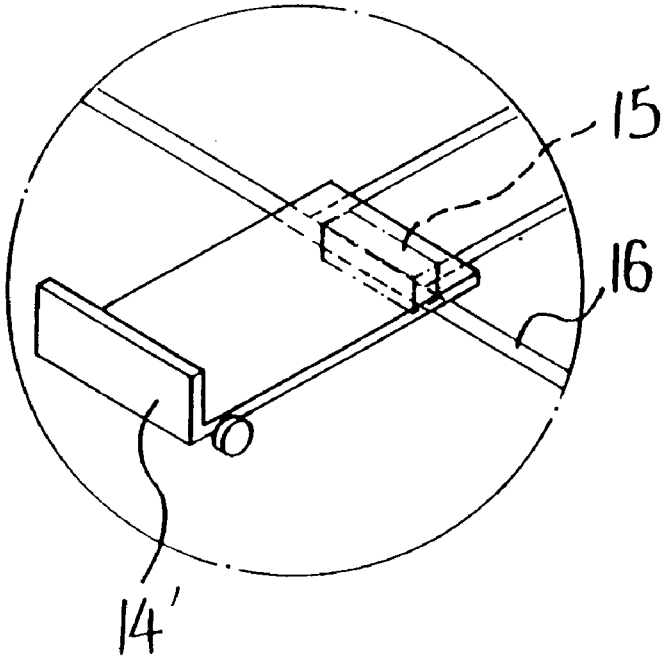
FIG. 1A is a perspective view of a slide plate.
Figure 2:
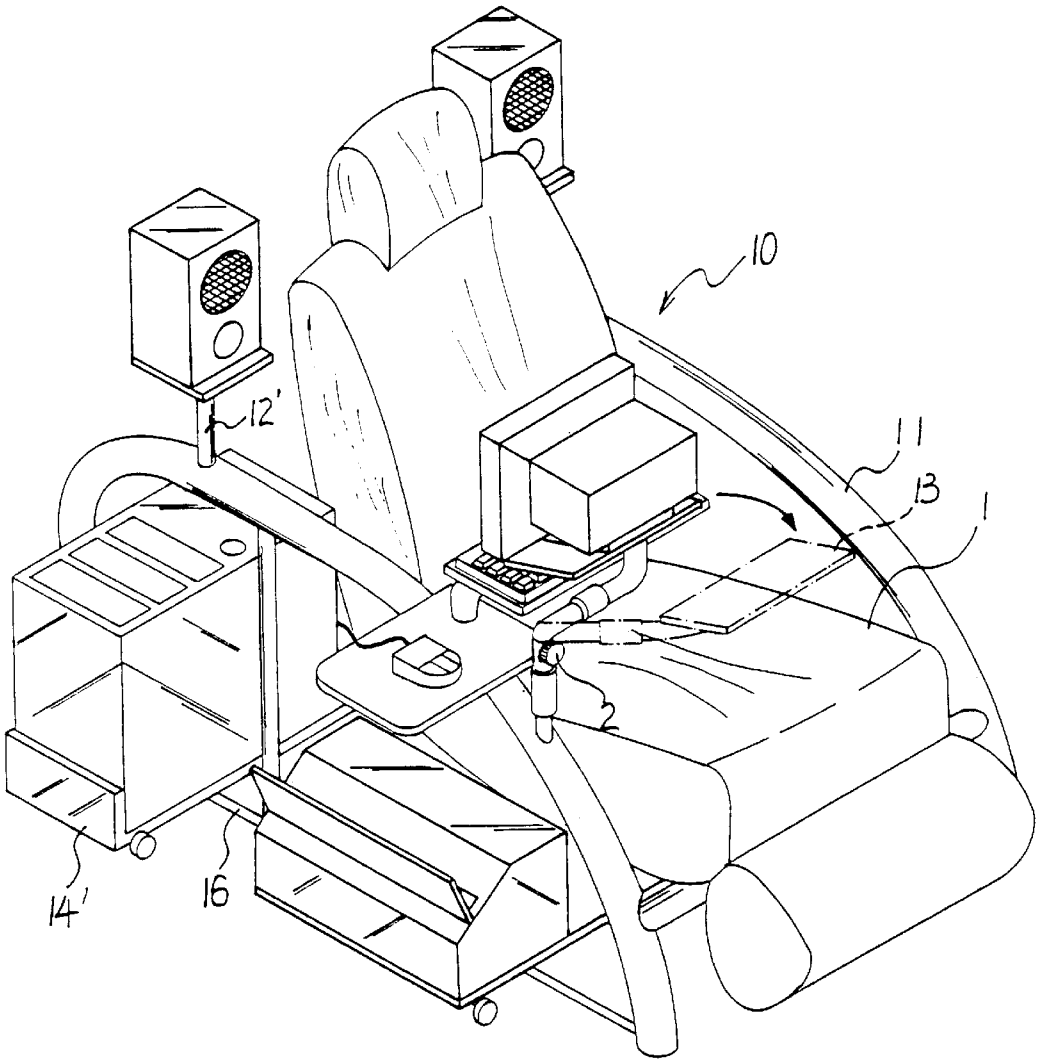
FIG. 2 is a perspective schematic view illustrating a plurality of articles disposed on a computer chair device of a preferred embodiment in accordance with the present invention.
Figure 3:
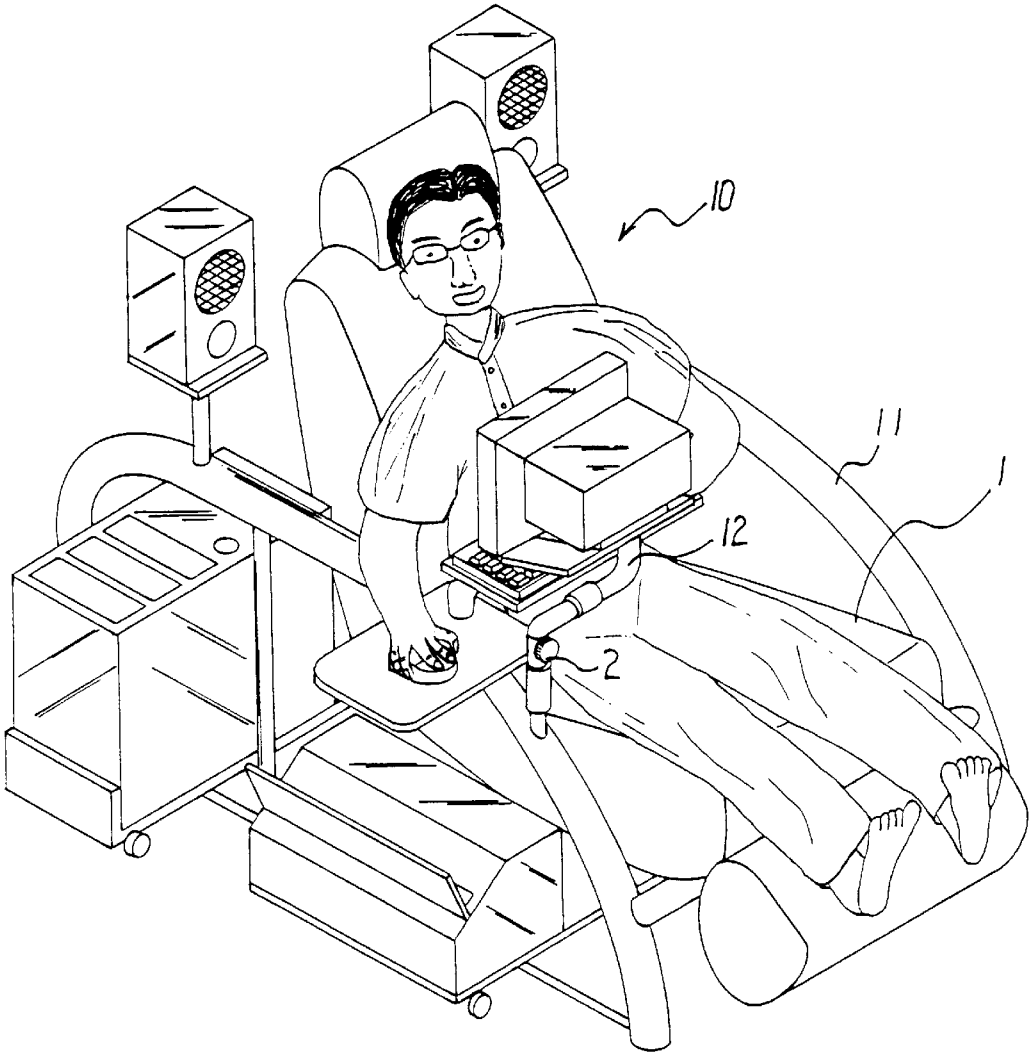
FIG. 3 is a perspective schematic view illustrating an operation of a computer chair device of a preferred embodiment in accordance with the present invention.

Referring to FIGS. 1 to 3, a first computer chair device 10 comprises a main frame 11, a main body 1 supported by the main frame 11, a support rod 12 disposed on the main frame 11, a table plate 13 disposed on the support rod 12, two support posts 12' disposed on the main frame 11, and two upper plates 13' disposed on the support posts 12' to support computer periphery articles.

A button 2 is disposed on the support rod 12 to adjust an angle of the support rod 12. Therefore, an angle of the table plate 13 is adjusted.

The main frame 11 comprises a plurality of bottom rods 16 connected to the main frame 11.

A base plate 14 is disposed on the bottom rods 16.

A slide plate 14' is disposed on the bottom rods 16. A protruded block 15 is disposed on the slide plate 14' to limit a movement of the slide plate 14' while the slide plate 14' is pulled outward.

Referring to FIGS. 2 and 3, a display monitor is placed on the table plate 13. A drawer is disposed on the slide plate 14'.

Figure 4:
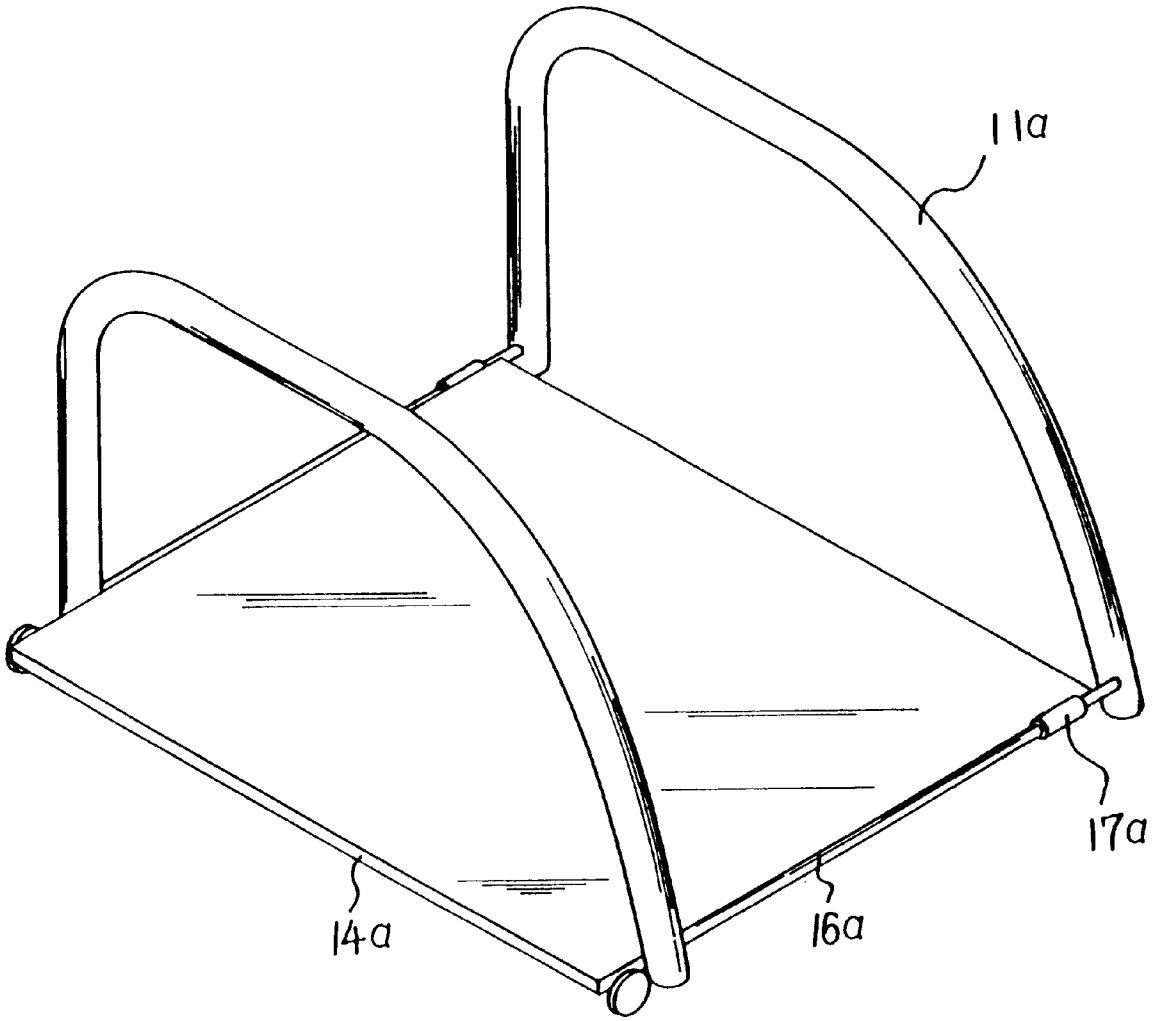
FIG. 4 is a perspective assembly view of a main frame and a slide plate of another preferred embodiment in accordance with the present invention.
Figure 4A:
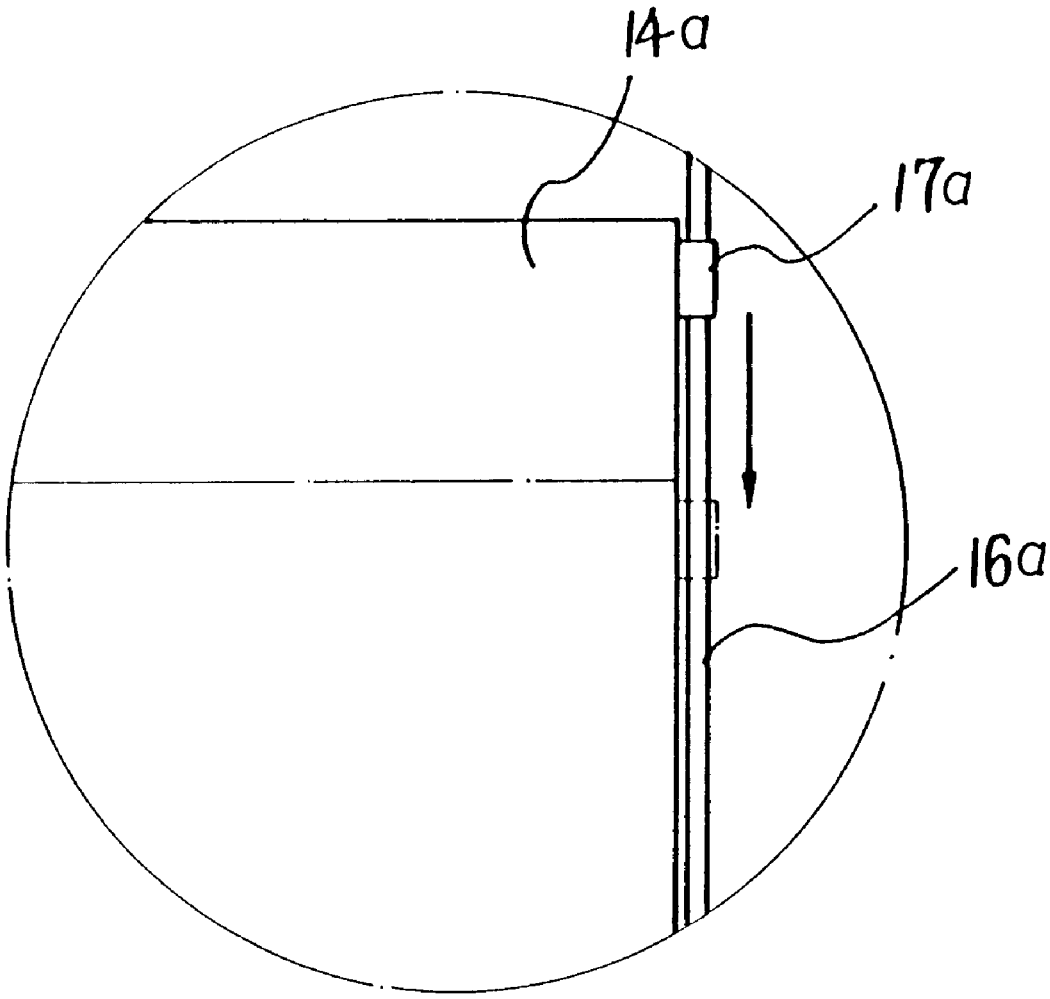
FIG. 4A is a schematic view illustrating an operation of a slide casing of a preferred embodiment in accordance with the present invention.

Referring to FIGS. 4 and 4A, another main frame 11*a* comprises a plurality of bottom rods 16*a*. A slide plate 14*a* is disposed on the bottom rods 16*a*. Each of the bottom rods 16*a* has a slide casing 17*a* disposed thereon to move along the respective bottom rod 16*a*.

The invention is not limited to the above embodiment but various modification thereof may be made. Further, various changes in form and detail may be made without departing from the scope of the invention.

I claim:

1. A computer chair device comprising:

a main frame, a main body supported by the main frame, a support rod disposed on the main frame, a table plate disposed on the support rod to support a display monitor, two support posts disposed on the main frame, two upper plates disposed on the support posts to support computer periphery articles, a plurality of bottom rods connected to the main frame, a base plate disposed on the bottom rods, a slide plate disposed on the bottom rods, a protruded block disposed on the slide plate to limit a movement of the slide plate while the slide plate is pulled outward, and each of the bottom rods having a slide casing disposed thereon to move along the respective bottom rod.

* * * * *